US007711138B2

(12) United States Patent
Howze

(10) Patent No.: US 7,711,138 B2
(45) Date of Patent: May 4, 2010

(54) LOUDSPEAKER INCLUDING A CONE CIRCUMSCRIBED BY A STIFFENER

(76) Inventor: Bruce W. Howze, 1 Harry's La., Broomall, PA (US) 19008

( * ) Notice: Subject to any disclaimer, the term of this patent is extended or adjusted under 35 U.S.C. 154(b) by 1057 days.

(21) Appl. No.: 11/346,097

(22) Filed: Feb. 2, 2006

(65) Prior Publication Data

US 2006/0233416 A1 Oct. 19, 2006

Related U.S. Application Data

(60) Provisional application No. 60/672,378, filed on Apr. 18, 2005.

(51) Int. Cl.
*H04R 25/00* (2006.01)

(52) U.S. Cl. ..... 381/398; 381/423

(58) Field of Classification Search ..... 381/386, 381/395, 396, 423–424, 426, 432, 398
See application file for complete search history.

(56) References Cited

U.S. PATENT DOCUMENTS

| | | | |
|---|---|---|---|
| 2,513,171 | A | 6/1950 | Hassan |
| 2,641,329 | A | 6/1953 | Levy |
| 4,115,667 | A | 9/1978 | Babb |
| 4,373,607 | A | 2/1983 | Miller |
| 5,608,810 | A | 3/1997 | Hall |

*Primary Examiner*—Suhan Ni
(74) *Attorney, Agent, or Firm*—Panitch Schwarze Belisario & Nadel LLP

(57) ABSTRACT

The present invention is a loudspeaker. The loudspeaker includes a frame, a cone having an outer edge in a shape of a reverse angle flange, and a reinforcing ring bonded to a back side of the flange.

8 Claims, 3 Drawing Sheets

LOUDSPEAKER INCLUDING A CONE CIRCUMSCRIBED BY A STIFFENER

CROSS-REFERENCE TO RELATED APPLICATIONS

This application claims the benefit of Provisional Application No. 60/672,378 entitled Carbon Ring Cone, filed Apr. 18, 2005, the contents of which are incorporated herein, be reference, in their entirety.

BACKGROUND OF THE INVENTION

A loudspeaker for audio signals converts electrical energy into mechanical energy by vibrating a diaphragm. The vibrating diaphragm causes motion of the surrounding air, thus producing acoustic energy.

The most common form of diaphragm for low frequency and midrange loudspeakers is a cone. A voice coil immersed in a magnetic field is attached to the neck of the cone, and the cone is attached to a rigid frame by means of flexible members at both the neck and the outer edge of the cone. These flexible members (i.e. a "spider" at the neck, and a "surround" at the outer edge) allow the cone to move fore and aft within the frame while maintaining axial alignment (i.e. preventing the cone from tilting or rocking).

In order to maximize the efficiency of the loudspeaker, and also extend its frequency range upward, the cone should have as little mass as possible. In order to reduce distortion, the cone should be as rigid as possible. In order to achieve high output capacity, the cone should have high mechanical strength. In order to move a high volume of air, the cone should be as large as possible within the given frame size. In order to achieve high output at low frequencies the cone assembly needs to be capable of long excursions.

Conventional loudspeakers are limited in the amount of acoustic energy that can be produced with acceptably audio low distortion. The limit arises primarily from the structure of the surround, which limits the excursions of the cone, and the stiffness of the cone, which distorts under large excursions.

The prior art offers different solutions to stiffening the cone. By way of example, U.S. Pat. No. 2,513,171 issued to J. A. Hassan, Jun. 27, 1950 discloses methods of stiffening a loudspeaker cone using struts extending from the voice to the outer edge of the cone.

U.S. Pat. No. 2,641,329, issued to S. Levy & A. Cohen, Jun. 9, 1953 deals with methods of stiffening a loudspeaker cone by attaching "transversely arched perforated plates bridging the central area of the diaphragm member" or by attaching a "horn shaped member secured at its smaller end to the junction of the dome cap and the diaphragm or directly to the dome cap, and secured at its larger end to the side of the diaphragm at a substantial distance from the smaller end.

U.S. Pat. No. 4,115,667, issued to B. Babb Sep. 19, 1978 discloses a method of stiffening a loudspeaker cone by means of a plurality of ribs extending along the surface of the dust cap and the surface of the cone.

U.S. Pat. No. 4,373,609 issued to C. D. Miller, February 1983, deals with a method of cone stiffening employing "a plurality of stiffener columns positioned in a plane to form a polygon essentially perpendicular to a central axis of the diaphragm with the ends of the columns being attached to the diaphragm intermediate the small end and the large end of the diaphragm.

Each of the aforementioned patents discloses a method of stiffening a cone which adds considerable mass to the cone, thus lowering the efficiency of the loudspeaker and reducing it's high frequency response. Accordingly, there is a need for a loudspeaker design which provides for delivering high volumes of air while simultaneously providing high electrical to acoustic efficiency, high frequency response and low distortion within a specified frame size.

BRIEF SUMMARY OF THE INVENTION

Briefly stated the present invention is a loudspeaker comprising a frame, a surround having a first end connected to the frame, and a cone having an outer edge in a shape of a reverse angle flange, where a front side of the flange is attached to a second end of the surround, and a reinforcing ring bonded to a back side of the flange.

Another aspect of the present invention is a loudspeaker comprising a frame, a cone having a first end and a second end, a surround connecting the first end of the cone to the frame, and a spider connecting the second of the cone to the frame, where the restoring force of the spider is greater than the restoring force of the surround.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
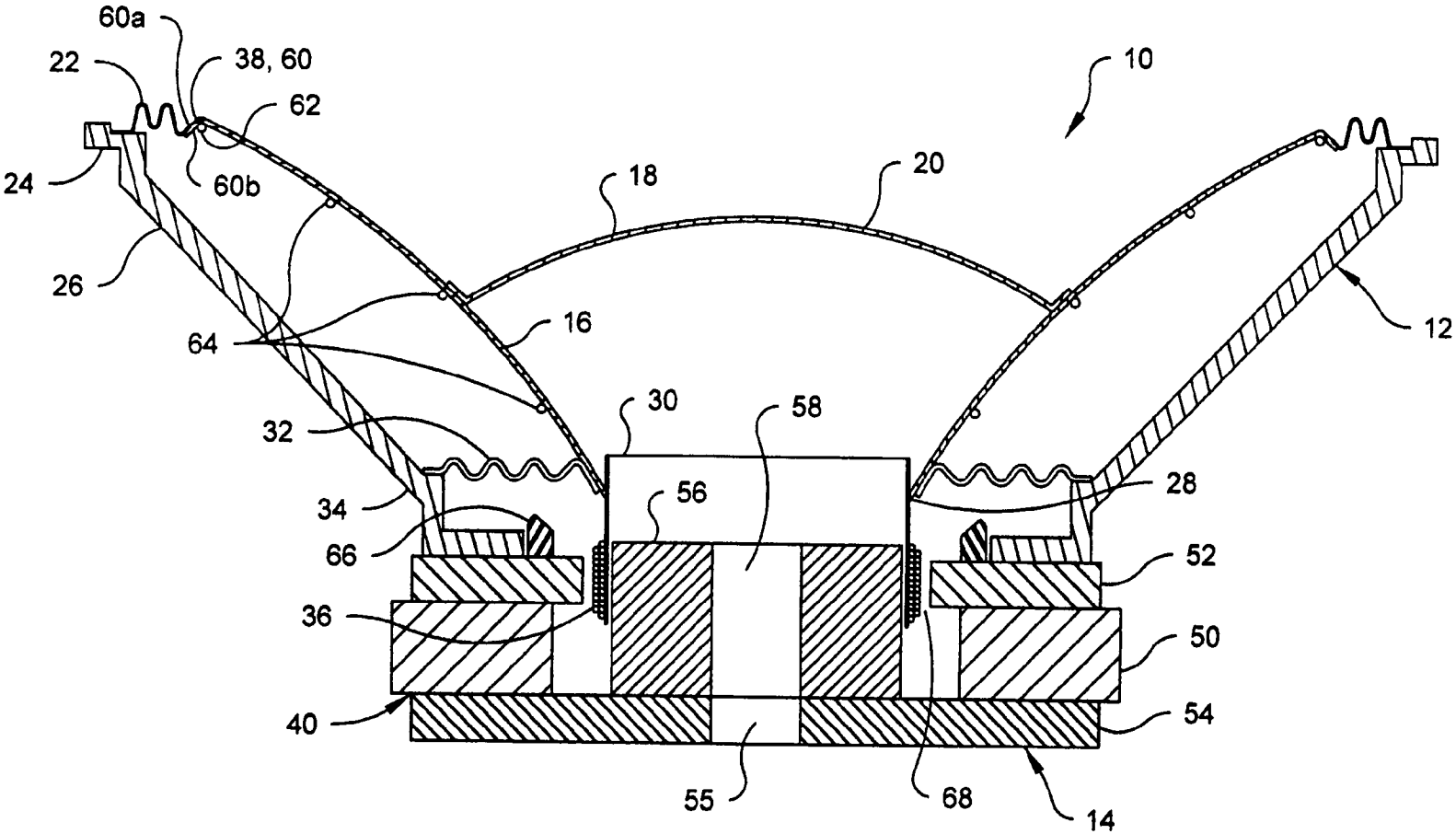
FIG. 1 is a sectional view of a loudspeaker according to a preferred embodiment of the present invention.

Referring now to FIG. 1 there is shown in sectional view, a preferred embodiment of a loudspeaker 10 according to the present invention. The loudspeaker 10 comprises a diaphragm assembly 12, and a driver assembly 14 that operates the diaphragm assembly 12 for producing acoustical output.

The diaphragm assembly 12 includes a frame 26, a cone 16 attached with an adhesive or the like to a dome 18 to form a diaphragm 20. An outer edge 38 of the cone 16 is connected to an upper end 24 of the frame 26 by a surround 22. A lower end 28 of the cone 16 is connected to a voice coil former 30 which forms part of the driver assembly 14. The voice coil former 30 (hereafter former) is in turn connected to the frame 26 through a flexible spider 32 that extends between the former 30 and a lower end 34 of the frame 26. With the arrangement of the surround 22 and the spider 32, the diaphragm 20 is free to move in an axial direction but is restrained from movement in a radial direction with respect to the frame 26.

The driver assembly 14 includes a voice coil 36 mounted on the voice coil former 30 and a permanent magnet assembly 40 that cooperates with the voice coil 36 for driving the diaphragm 20. The voice coil 36 is typically constructed of aluminum or copper wire and is attached to the voice coil former 30 by a conventional adhesive. The voice coil 36 is electrically connected to terminals of the loudspeaker through wires.

Figure 4:
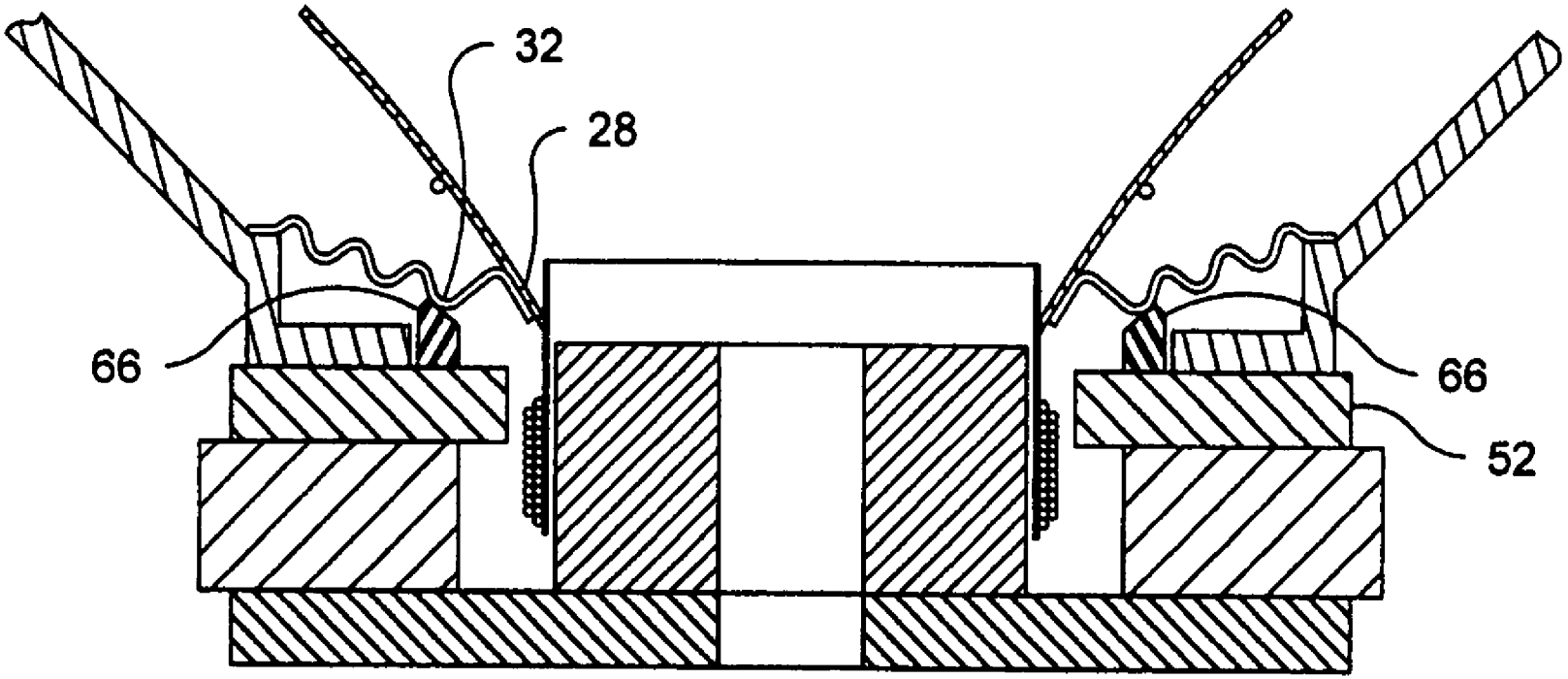
FIG. 4 is a sectional view of the preferred embodiment of the loudspeaker showing a cone of the loudspeaker in extreme rearward excursion.

The permanent magnet assembly 40 is generally annular in shape and is centrally located with respect to a central axis of the diaphragm assembly 12. The permanent magnet assembly 40 includes a permanent magnet 50 disposed between a top plate 52 and a back plate 54. The top plate 52 is rigidly connected to the frame 26. A bumper 66 of soft rubber or other elastic material, is attached to a top surface of the top plate 52 proximate the second end of the cone 16. As shown in FIG. 4, the bumper 66 is located such that the bumper 66 contacts the spider 32 near the lower end 28 of the cone 16 at extreme excursions of the cone 16 thus preventing the neck of the cone 16 from striking the top plate 52 and being damaged due to excessive rearward excursion. Preferably, the bumper 66 is in the shape of a ring surrounding the former 30 but need not totally surround the former 30.

The top and back plates 52, 54 are constructed of a material capable of carrying magnetic flux, such as steel. A pole piece 56 of generally cylindrical shape is connected to the back plate 54 and extends generally toward the diaphragm 20. The pole piece includes a pole vent 58 that is coincident with an opening 55 in the top plate 54. A space or gap 68 is formed between the pole piece 56 and the top plate 52, the permanent magnet 50, and the back plate 54. The voice coil 36 is positioned in the gap 68.

In use, changing current is applied to the voice coil 36 through the terminals. The voice coil 36 in turn produces a magnetic field which interacts with the magnetic field produced by the permanent magnet assembly 40. The interaction of the magnetic fields causes the voice coil 26 to oscillate linearly in accordance with the applied changing current. Oscillation of the voice coil 26 in turn pumps the diaphragm 20 linearly to generate sound. Movement of the diaphragm causes a change in volume of the airspace between the diaphragm assembly 12 and driver assembly 14. When the diaphragm 20 moves away from the pole piece 56, air is drawn toward the diaphragm 20 through the vent opening 55 of the bottom plate 54 and the pole vent opening 58 of the pole piece 56. Likewise, when the diaphragm 20 moves toward the pole piece 56, air is pushed through the pole vent 58 and opening 55.

In the preferred embodiment, the outer edge 38 of the cone 16 is in the shape of a reverse angle flange 60. The reverse angle flange 60 serves to stiffen the outer edge 38 of the cone 16. Preferably, the width of the flange 60 ranges from 0.1 inch to 0.15 inch depending on the size of the cone 16 with 0.15 inches being more suitable for 12 inch and larger cones 16. Preferably, the interior angle of the flange 60 is determined such that the force on the flange when the cone is at a maximum excursion is substantially in line with the plane of the flange 60. In this manner, forces perpendicular to the face of the outer edge 38 of the cone 16 are avoided, thus reducing the tendency for the outer edge 38 of the cone 16 to crack under repeated extreme excursion conditions. In the preferred embodiment the interior angle of the flange 60 is approximately ninety degrees but the preferred angle of the flange 60 could be other than ninety degrees depending on the size of the extreme excursions of the cone 16.

A reinforcing ring 62, circumscribing the cone 16, is bonded to a back side 60*b* of the flange 60. The reinforcing ring 62 is preferably made of a high stiffness and low mass material. More preferably, the reinforcing ring 62 is made of uni-directional carbon fiber material bonded to the cone 16 with an adhesive. However other materials such as, for instance, Kevlar or glass fibers could also be used for the reinforcing ring 62. The reinforcing ring 62 provides substantial additional stiffness and strength to the edge of the cone 16. Additional reinforcing rings 64 which circumscribe the cone 16 may also be employed further down the body of the cone 16, to further stiffen the cone 16 and reduce break-up of the cone 16 at higher frequencies.

Figure 2B:
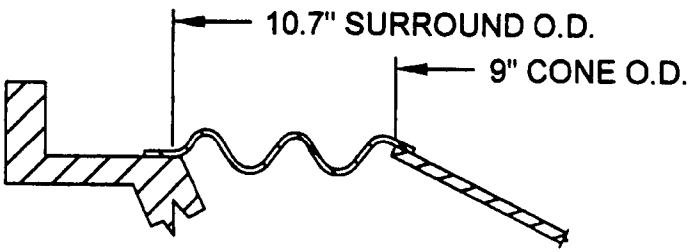
FIG. 2B is a is a sectional view of a cone edge and a surround of a conventional loudspeaker in a rest position.
Figure 2A:
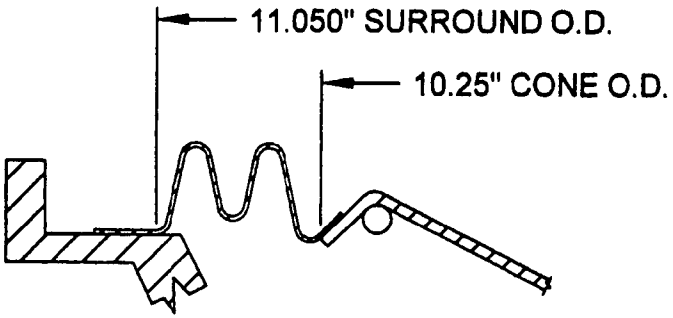
FIG. 2A is a sectional view of a cone edge and a surround of the present invention in a rest position.

Preferably, a front side 60*a* of the reverse angle flange 60 is connected to an upper end 24 of the frame 26 by a flexible suspension, referred to as the surround 22. As shown in FIG. 2A, the surround 22 comprises a plurality of wavelike pleats. Preferably the surround 22 is made of treated cloth but could be made of other materials, such as for instance, rubber or urethane. As further shown in FIGS. 2A and 2B, the peak to peak heights of the pleats compared to the distance between the peaks is greater for the surround 22 than for a conventional surround. Preferably, the ratio of the peak to peak height of the surround 22 to the distance between the peaks of the surround 22 is approximately 0.7 when the surround is at rest. However, the ratio could be as low as 0.5 and still be within the scope of the invention.

The narrow width of the surround 22 compared to that of the conventional surround enables the diameter of the cone 16 to be larger for a specified frame size than the cone of a conventional loudspeaker, thus the loudspeaker 10 is able to move larger volumes of air for a specified frame size. For example, as shown in FIGS. 2A and 2B, the outside diameter of the cone 16 of a 12" cone assembly is increased from 9 inches for a conventional loudspeaker to 10.25 inches when using the inventive surround 22.

Figure 3B:
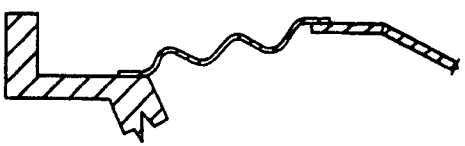
FIG. 3B is a sectional view of a cone edge and a surround of the conventional loudspeaker in a rest position.
Figure 3A:
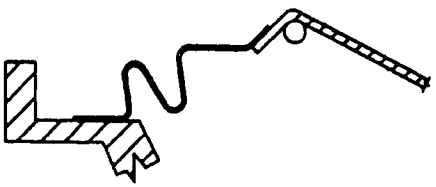
FIG. 3A is a sectional view of a cone edge and a surround of the present invention in an extended position.

The primary function of the surround 22 is to provide radial location of the cone and air seal. Accordingly, in the preferred embedment the restoring force of the surround 22 is made less than the restoring force of the spider 32. Also, as shown in FIG. 3A the surround 22 is designed such when it is in an extended position, the force applied to the outer edge 38 of the cone 16 through the surround 22 is substantially in line with the plane of the flange 60. This is in contrast to the surround of a conventional loudspeaker (FIG. 3B) where the surround exerts a force normal to the plane of the outer edge 38 of the cone 16 thus having the potential for causing the outer edge 38 of the cone 16 to crack.

As would be apparent to those skilled in the art, the combination of an edge of the cone 16 reinforced with the carbon fiber ring 62 and the narrow and tall surround 22 results in an improved loudspeaker capable of increased life/higher efficiency and lower distortion in a specified frame size than heretofore achieved with conventional loudspeakers.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A loudspeaker comprising:

a frame;

a cone having an outer edge in a shape of a reverse angle flange; and a reinforcing ring bonded to a back side of the flange, said reinforcing ring being disposed entirely within a width of the flange.

2. The loudspeaker of claim 1, wherein an interior angle of the flange is approximately ninety degrees.

3. The loudspeaker of claim 1, wherein the reinforcing ring is made of carbon fiber.

4. The loudspeaker of claim 1, further including at least one additional reinforcing ring circumscribing the cone.

5. The loudspeaker of claim 1, further including a pleated surround connecting the outer edge of the cone to the frame, wherein an interior angle of the flange is such that a force exerted by the surround on the flange when the cone is at a maximum excursion is substantially in line with the plane of the flange.

6. The loudspeaker of claim 1, further including a surround connecting the outer edge of the cone to the frame, wherein the surround comprises a plurality of wavelike pleats, the peak to peak height of the surround being greater than 0.5 times the distance between the pleats when the surround is at rest.

7. The loudspeaker of claim 1, further including a surround connecting the outer edge of the cone to the frame, wherein the surround comprises a plurality of wavelike pleats, the peak to peak height of the surround being approximately equal to 0.7 times the distance between the pleats when the surround is at rest.

8. The loudspeaker of claim 2, wherein said reinforcing ring is disposed at the interior angle of the flange.

* * * * *